US005273387A

United States Patent [19]

Groswith, III et al.

[11] Patent Number: 5,273,387

[45] Date of Patent: Dec. 28, 1993

[54] PUNCHED PAPER SHEETS BINDING APPARATUS

[75] Inventors: Charles T. Groswith, III, Los Altos; Richard D. Phipps, Morgan Hill; Robert L. Lathrop, Jr.; John F. Stewart, both of San Jose; Rick J. Kaufmann, Los Gatos, all of Calif.

[73] Assignee: Taurus Tetraconcepts, Inc., Mountain View, Calif.

[21] Appl. No.: 976,790

[22] Filed: Nov. 16, 1992

Related U.S. Application Data

[62] Division of Ser. No. 381,612, Jul. 18, 1989, Pat. No. 5,007,782, and Ser. No. 685,351, Apr. 15, 1991, Pat. No. 5,163,350.

[51] Int. Cl.[5] ..... B42B 9/00

[52] U.S. Cl. ..... 412/40; 412/38

[58] Field of Search ..... 412/38, 39, 40

[56] References Cited

U.S. PATENT DOCUMENTS

| | | | |
|---|---|---|---|
| 2,108,136 | 2/1938 | Nelson et al. | 412/40 |
| 2,334,815 | 11/1943 | Emmer | 412/40 |
| 2,603,801 | 7/1952 | Emmer | 412/40 |
| 2,820,975 | 1/1958 | Ruck et al. | 412/40 |
| 2,851,708 | 9/1958 | Ruck et al. | 412/40 |
| 2,898,613 | 8/1959 | Frederick | 412/40 |
| 3,060,780 | 10/1962 | Stuckens | 83/590 |
| 3,122,761 | 3/1964 | Bouvier | 11/1 |
| 3,699,596 | 10/1972 | Lyon | 83/549 X |
| 3,967,336 | 7/1976 | Cutter | 83/590 X |
| 4,607,993 | 8/1986 | Scharer | 412/40 |

*Primary Examiner*—Mark Rosenbaum
*Assistant Examiner*—S. Thomas Hughes
*Attorney, Agent, or Firm*—Skjerven, Morrill, MacPherson, Franklin & Friel

[57] ABSTRACT

A binding apparatus having a base portion and a binding mechanism is disclosed which binds a stack of punched paper sheets with a plastic binding element having an elongated linear spine and integral spaced resilient curled fingers extending from the spine. The binding mechanism includes a fixed binding comb and a series of push fingers. The binding comb has a series of upstanding fixed spaced pickets having sufficient clearance between each other to allow the binding element curled fingers to be manually shifted laterally relative to the fixed pickets such that each of the curled fingers surrounds a portion of the push fingers. The binding mechanism also has a device for moving the push fingers outwardly from the pickets to uncurl the curled fingers so that a stack of punched paper sheets can be placed on the uncurled fingers.

11 Claims, 8 Drawing Sheets

35
34
33
59
36
D
C
F
A
B
E
21
11
65
64
24
70
60
76
63
5
72
62
22
4

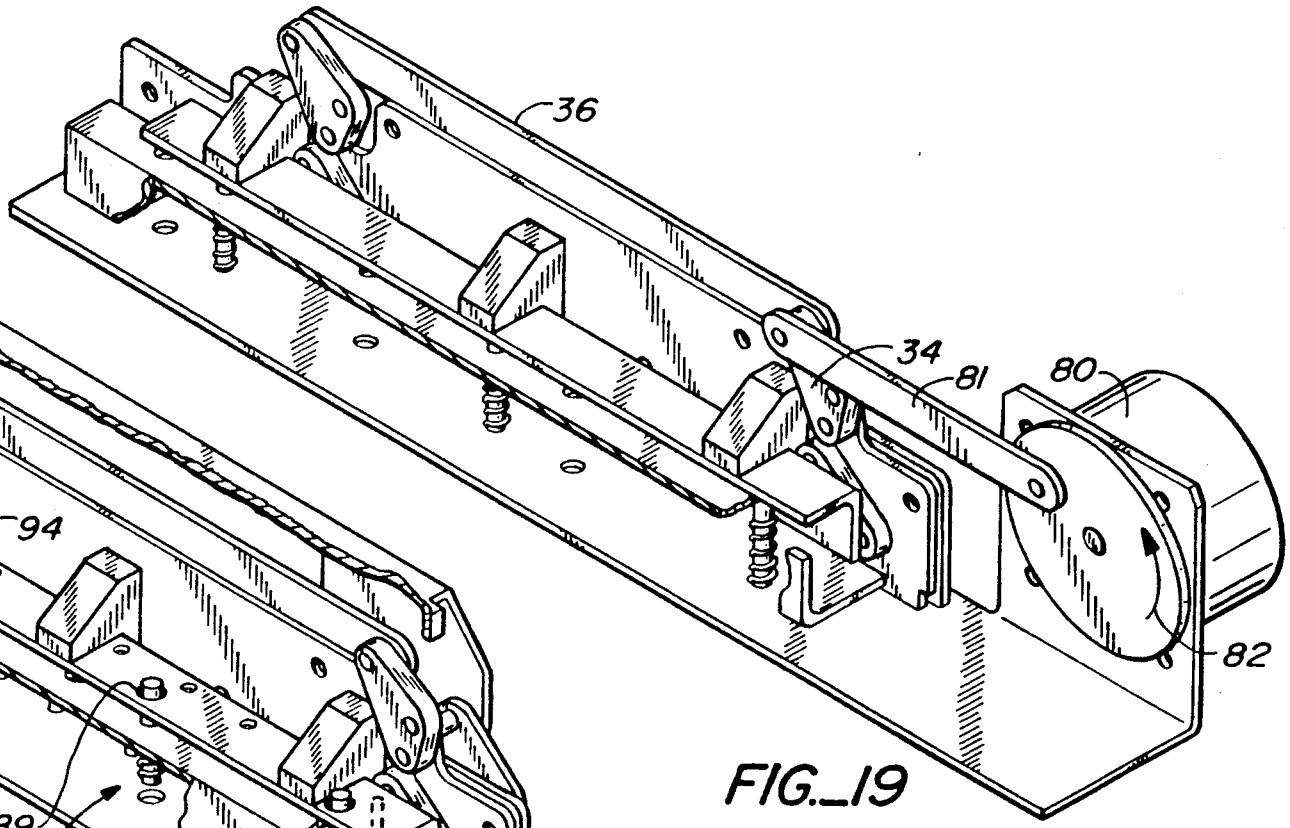
FIG._19
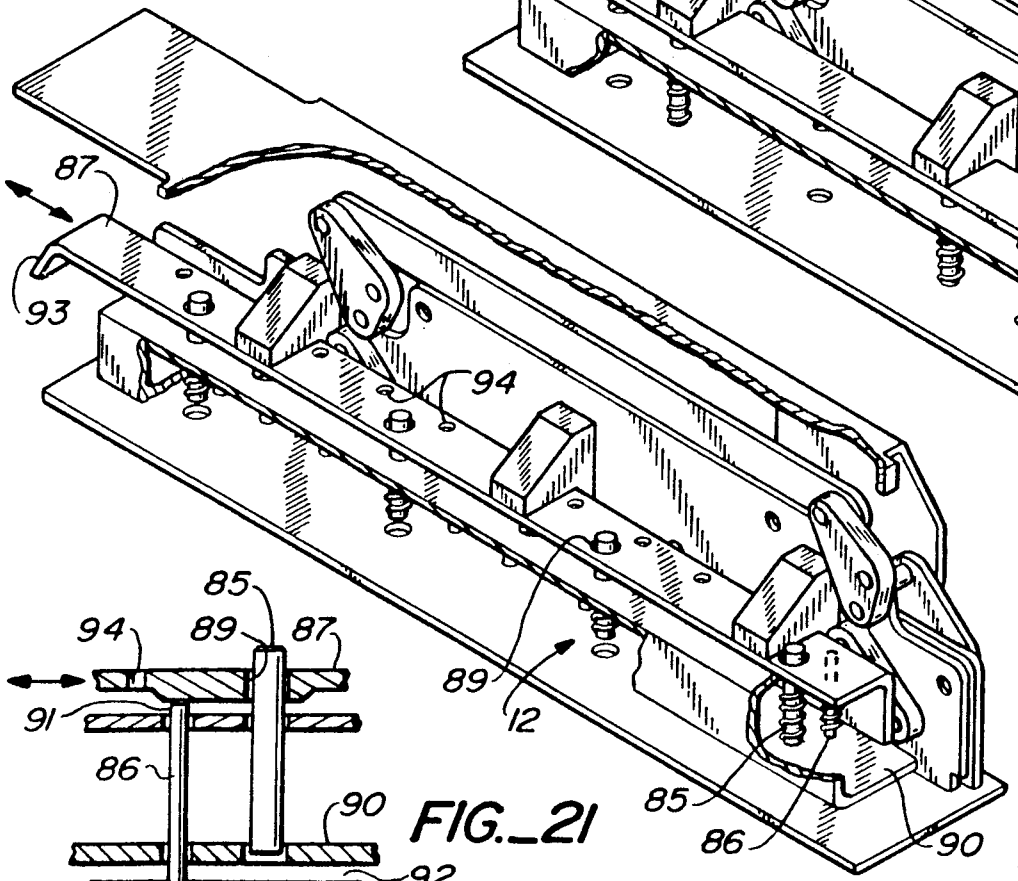
FIG._20
FIG._21

PUNCHED PAPER SHEETS BINDING APPARATUS

This application is a division of application Ser. No. 07/381,612, filed Jul. 18, 1989 now U.S. Pat. No. 5,007,782 and Ser. No. 07/685,351, filed Apr. 15, 1991 now U.S. Pat. No. 5,163,350 .

CROSS-REFERENCE TO RELATED APPLICATIONS

This application relates to a design application entitled "Paper Punch and Binding Machine", inventors Robert L. Lathrop, Jr., Richard D. Phipps, and Loren D. Stirling, Ser. No. 07/353,737 filed May 18, 1989 now U.S. Design Pat. No. D-320,407 issued Oct. 1, 1991.

FIELD OF THE INVENTION

This invention relates to an apparatus for punching holes in a marginal edge of a stack of paper sheets and for binding a stack of paper sheets with connector elements which extend through the punched holes. More particularly the invention is directed to a single generally hand-operated apparatus for office, business, school or home use in which various round and rectangular apertures may be punched in the paper stack and wherein various sized binding strips can be assembled to complete a binding operation.

BACKGROUND OF THE INVENTION

Individual paper punch mechanisms have been ganged into an assembly for simultaneously punching of two, three. four or even five or more round 9/32" (7 mm) holes in an edge margin of a stack of paper sheets inserted into the assembly. This type punch is exemplified by U.S. Pat. Nos. 2,368,790 and 3,724,734. The resultant apertured stacked sheets are then removed for assembly with suitable fasteners such as ACCO—fasteners or those seen in U.S. Pat. No. 4,730,972. Specially sized separate punch mechanisms and apparatus have also been developed and commercialized for the simultaneous punching of a large number of rectangular apertures, for example 19 or 21 apertures, in a marginal edge of a stack of paper sheets. Such rectangularly punched sheets are then taken to a separate apparatus for a so-called "plastic resilient loop" binding operation where plastic binding strips having a corresponding number (19 or 21) of integral curled resilient binding fingers. The broad resilient loop type binding is seen in U.S. Pat. No. 1,970,285 to Douvry. Binding machines for this type of loop binding are seen in U.S. Pat. No. 2,257,714 in which the binding is placed over a series of hooks, corresponding to the number and spacing of the loops, and an operating lever is pulled down to move a second series of hooks laterally to a position within the loops and downward to open the loops sufficiently to allow placement or threading of rectangular apertures of apertured paper sheets thereover, with return of the lever to its original position allowing the resilient loops to return to their original closed form. The bound booklet then is lifted off the first series of hooks. This general type of device is in commercial use by General Binding Corporation in its GBC 2000 machine. U.S. Pat. Nos. 2,593,805 and 2,851,708 are directed to similar loop-opening devices, the latter including angular guide slots and fingers pivotally carried by a slide member on the machine.

Binding machines for the Douvry-type binder with punch capabilities have also been developed as seen in U.S. Pat. No. 3,060,780. An exterior handle extending transverse to a paper platen is movable downwardly to do the punching. A second series of hooks with bent tabs mounted on a bar are moved into latched position within the loops. The same downward handle movement moves the tabs rearwardly, opening the loops for assembly of the punched paper sheets thereon. The moving handle and laterally moving bar are returned to their original positions and the bound booklet removed. U.S. Pat. No. 3,699,596 is directed to a punch and binding machine for the loop-type bindings in which a lever in one direction operates the punch and in the other direction operates to move the comb laterally and to open the curled fingers forwardly.

U.S. Pat. No. 3,122,761 discloses a camming drive for a book binding machine which moves an uncurling slide both transversely and longitudinally of a comb. U.S. Pat. No. 3,227,023 is directed to a powered punching apparatus with manual binding action. An uncurling slide also moves both transversely and longitudinally and provision is made to adjust a gauge plate dependent on the depth of holes to be punched and adjust movement of the slide dependent on the diameter of the binding element. U.S. Pat. Nos. 4,613,266 and 4,607,993 also show similar binding elements and machines including a cover defining a table means aligned with the punch means which have guide means for positioning both paper sheets and oversized covers on the table means, and a paper stack thickness gauge, respectively. It is believed that elements of the last four patents are incorporated in the GBC ImageMaker 2000 machine.

SUMMARY OF THE INVENTION

The present invention is directed to a paper punching apparatus which is capable of punching both round and rectangular holes in a paper sheets stack and a simplified binding station which allows for uncurling of the loop fingers of a Douvry-type binding element in an overall small, light-weight, attractive and relatively inexpensive device. Particularly, the apparatus of this invention has a desk footprint of only about 30% of a GBC ImageMaker 2000 machine, is of less height and only about 40% of the weight of such GBC machine. Further, the present invention provides a dual punching capability whereby stacks of paper sheets may also be punched with two or three round holes for use in standard ACCO-type or prong-type bindings or for use with post and collar connectors as seen in U.S. Pat. No. 4,730,972 or with 11 or 12 small ⅛" (3 mm) round holes for use with the Velo-Bind type connectors of U.S. Pat. No. 4,369,013. At the same time, i.e. simultaneously by operation of a single lever, a punch plate having integral punch elements with a rectangular cross-section is actuated to punch a large number of rectangular holes in a marginal edge of another paper sheets stack to be assembled with a Douvry-type binding element, or with the modified Velo-Bind-type binding strips of U.S. Pat. No. 4,620,724. Alternatively, integral punch elements with a square cross-section may be employed for punching apertures in a paper sheets stack to be bound by the binding strips of U.S. Pat. No. 3,970,331.

A simplified binding station is provided adjacent one longitudinal edge of an apparatus base portion. A binding comb is provided having pickets or teeth which are substantially narrower than those heretofore employed in utilizing the Douvry-type binding elements. This allows a user/operator to merely place the spine of the binding element behind the pickets with the binding fingers extending forwardly between the pickets. The binding element is then manually moved by translation so that the element of each of the push fingers, which are used to uncurl the resilient curled fingers of the binding element, are situated behind the curled fingers. Thus no complicated translation and longitudinal motion members need be incorporated in the binding machine as generally shown in the prior art discussed above. Further, rather than using a long lever extending from the side of the machine casing for the uncurling operation, which in reality needs only a small force relative to the force required to punch multiple holes in multiple sheets of paper, a conveniently positioned finger-operated knob is provided which is rotatable to initiate a simple gear train to outwardly move a plate mounting the push fingers to uncurl the curled resilient fingers.

In order to accurately guide the respective round punch elements and the punch plate having integral rectangular punch elements in a straight line and to provide additional mechanical advantage to the lever or crank force used to actuate the punch mechanisms particular at the start or top of the lever stroke, a special four-bar linkage was developed. This linkage provides for a four-fold increase in mechanical advantage. This is in addition to the over twenty-fold mechanical advantage already present in the form of the long, approximately 12 inch (17.5 cm) lever length. A high force is needed to initially compress the marginal edges of the paper sheets stack and to start the actual punching of the holes by a shearing action. As increasing numbers of sheets are pierced there is less need of this high force and provision has been made to have the mechanical advantage due to the linkage at the bottom of the stroke approach unity in the four-bar linkage. This provides a "soft landing" for the lever when it shears through the last of the sheets and an abrupt shock, as present in many prior art punch devices, is minimized. A pair of the four-bar linkages are connected in a parallelogram arrangement by a long link to assure that the respective punch mechanisms have the vertical straight line punch path at both ends of their longitudinal span and the punch plate and punch ends are kept level.

Particular embodiments of the invention include a hand-operated lever as the crank of the linkage or a motorized drive link for actuating the four-bar linkage. A further embodiment of the invention provides a dual punch mechanism for interchangeably punching round holes of different diameters. A row of relatively large diameter punches allows punching of 2, 3 or 4 loose-leaf paper sized holes and a row of smaller diameter punches allows punching of 11 or 12 round holes of ⅛" diameter for a Velo-Bind type binding operation. An additional embodiment includes a second punch mechanism with or without a binding station for simultaneously punching rectangular holes in another stack of paper sheets.

BRIEF DESCRIPTION OF THE DRAWINGS

FIG. 19 is a perspective view of a motorized version of the apparatus.

FIG. 20 is a cutaway perspective view of a hand-operated lever version of the invention showing dual rows of punches for variously punching rows of round holes of different sizes and spacing.

FIG. 21 is a partial simplified side view of the mechanism for rendering one row of round punches inoperative and the other row of round punches operative.

DETAILED DESCRIPTION

Figure 1:
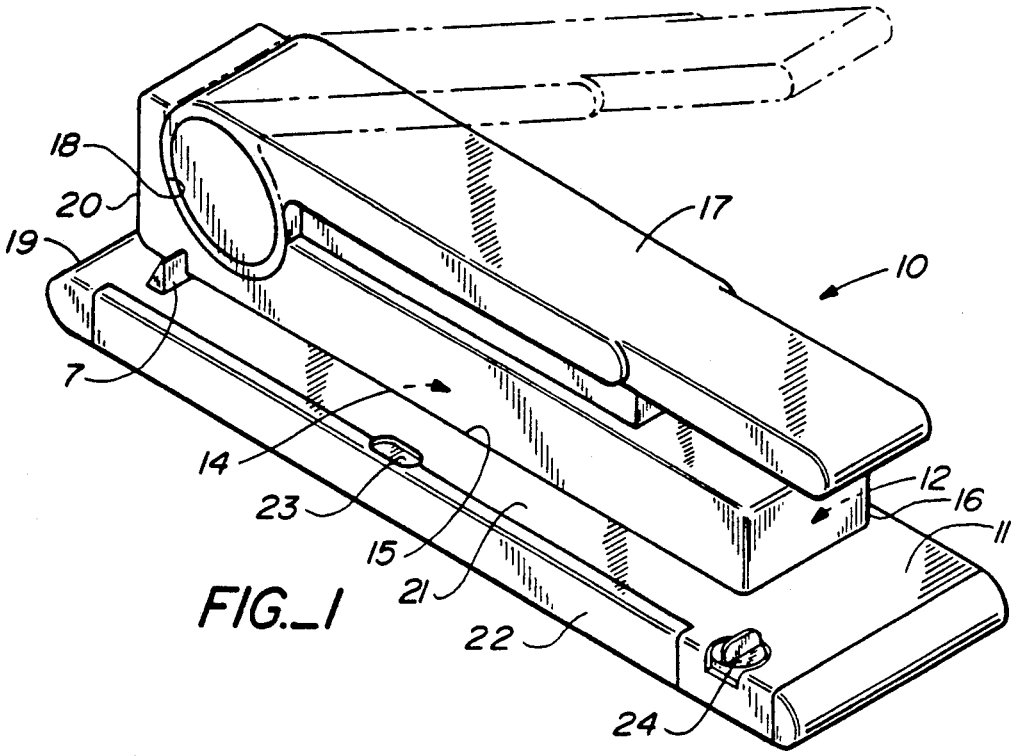
FIG. 1 is an exterior perspective view of the combined paper punch and binding apparatus of the invention.

The combined punch binding.. apparatus 10 is seen in exterior view in FIG. 1 where a base portion 11 is placed on work surface table (not shown) or the like. Base portion 11 comprises a lower elongated flat rectangular section 19 and an upper narrower section 20 spaced above section 19 so that first and second longitudinal linear edges 15 and 16 form horizontal slots with a top surface 21 of lower base section 19. A round hole punch mechanism 12 accessed under edge 16 into a slot and a rectangular hole punch mechanism 14 accessed under edge 15 into an opposed slot are positioned within the upper base section 20. A marginal edge of a stack of paper sheets is insertable into one or the other or in both of the slots and into the respective punch mechanisms as more clearly shown in FIG. 8. The punch mechanisms are simultaneously operated and have a common drive linkage and two parallel punch systems operable to punch holes in the inserted paper stack by downward movement of a crank in the form of a lever 17 extending parallel to the major longitudinal axis of the overall apparatus. The lever is pivotally attached to one end of the upper base section 20 in a semi-cylindrical cavity 18 therein. The cantilevered end of lever 17 extends beyond the opposite end of section 20 to facilitate hand movement of the level to a lever "up" position shown in dash-dot lines. An adjustable paper stack guide 7 extends upwardly from the top surface 21 of bottom section 19 to guide the bottom marginal edge of the paper stack into punching mechanism 14. A similar guide (not shown) is similarly positioned adjacent to the second linear edge 16.

A binding station is provided in an elongated edge recess 3 (FIG. 12) of the bottom base section 19 which is closable by a pivoted binder door 22 having a depressed thumb hold 23 for ease of opening. Extending from the top surface 21 of section 19 immediately adjacent door 22 is a binding control knob 24. The binding section is contained in a recess or compartment within base section 19. In a preferred embodiment base section 19 is 2.5 cm high×11 cm wide×40 cm long, while the compartment is 2.5 cm high×1 cm deep×32 cm long.

When cover 22 is closed the flat surface 21 of bottom base section 19, with the cover top edge, forms a narrow platen for feeding the paper sheets stack into the punch mechanism 14 under linear edge 15. Due to the relatively low height of section 19, the remainder of the paper sheets stack can merely drape over the section 19 more particularly over surface 21 in the same manner as the stack 5 shown in FIG. 15 in a binding operation, but extending from surface 21 to the work surface 4. The remainder major portion of the paper sheets stack rest on the same work surface as does the overall apparatus, thus minimizing the size of the apparatus.

Figure 2:
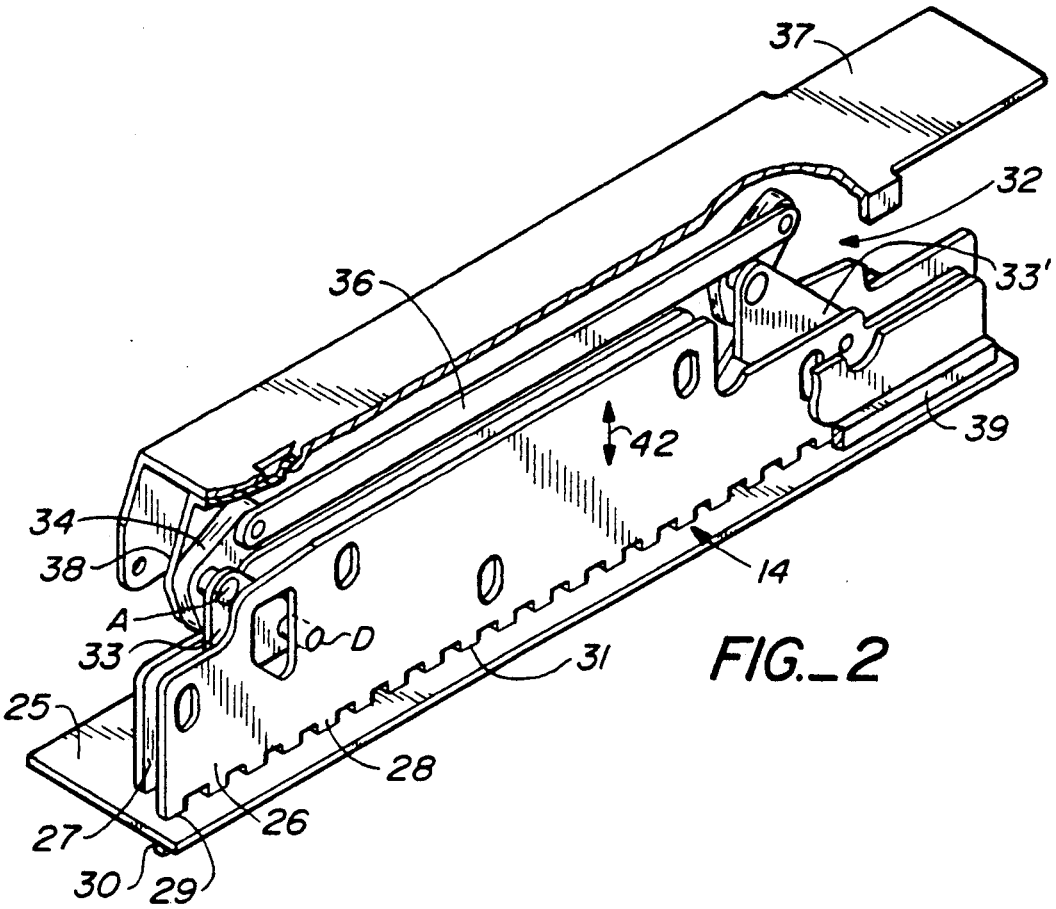
FIG. 2 is a perspective breakaway view showing a punch blade for punching rectangular holes.

FIG. 2 illustrates the construction and operation of the rectangular punch mechanism 14 which extends longitudinally adjacent to the second linear edge 15 of the base portion 11 and with the top section 20 of the base portion. A four-bar linkage 32 is attached to the handle or lever support 37 and to a vertically oriented punch blade 26 which as shown by arrow 42 is vertically movable with respect to a die plate 25 fixedly mounted in base bottom section 19. The die plate includes a series of rectangular apertures 31, normally 19 or 21 in number, corresponding to the number of rectangular punch holes to be made in a paper sheets stack marginal edge. The punch plate 26 has a corresponding number of integral punch elements 28 of rectangular cross section which in a downward stroke of the punch plate shear the paper stack marginal edge to form the desired rectangular punched holes. On an "up" stroke a punch stripper bar 39 holds the top of inserted paper stack marginal edge inboard of the apparatus so that the punch integral elements can be easily withdrawn from the holes which it has made. A guide groove hole 29 is also provided in the die plate 25 for reception of a guide leg 30 integral with punch plate 26 which is in slidable engagement with hole 29. Additional guide holes and legs may be provided. This arrangement insures that the longitudinal axis of blade 26 is kept oriented exactly with the axis of the row of apertures 31 in the die plate.

Figure 4:
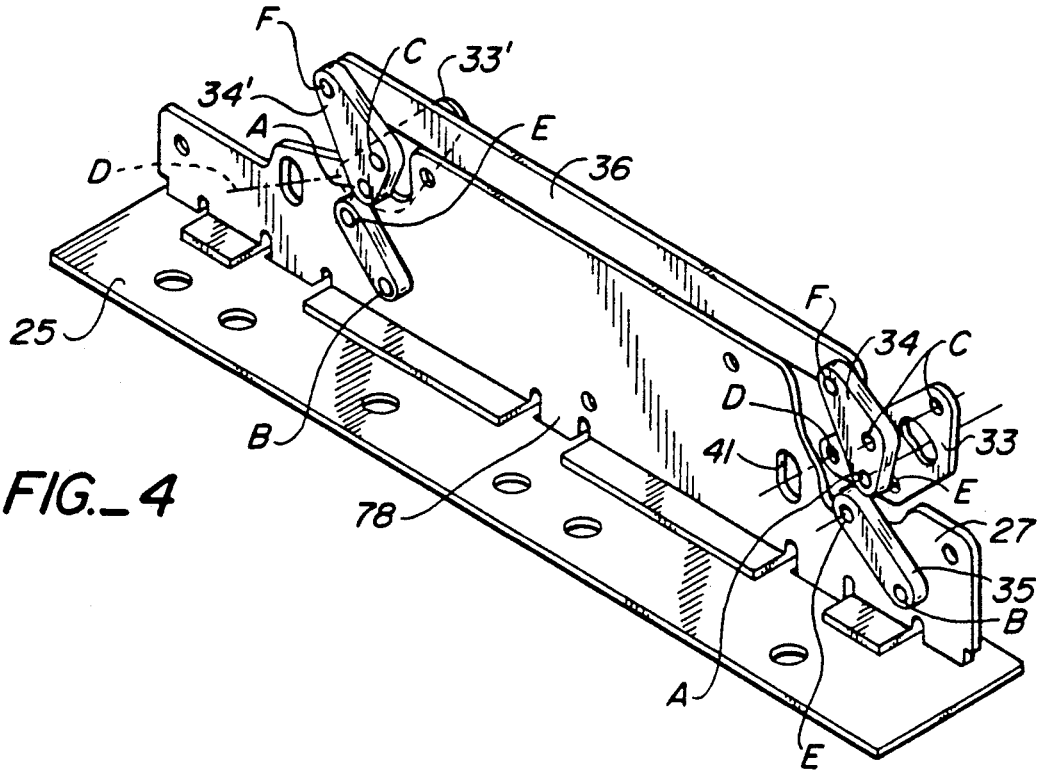
FIG. 4 is a perspective view of dual sets of four-bar linkages.

The lever support 37 is covered by a pair of abutting cover portions (not shown) which with the lever support 37 form the overall lever handle 17 as shown in FIG. 1. The four-bar linkage which is described in detail with respect to subsequent Figures comprises a coupler plate 33 having three triangularly spaced first, second and third coupler interconnect points. As seen more clearly in FIG. 4, the first point C is connected to link 34 which in turn is connected to a lever/crank support extension 38 (FIG. 2). The second point E is connected to one end of an elongated short link 35 (FIG. 4), sometimes called a rocker arm, having its other arm pivotally attached at point B to an elongated linear vertical plate 27 fixedly upstanding from the horizontal die plate 25 (FIG. 4). The third point D is a pin connected to the punch blade 26 which pin extends through a vertical slot 41 in vertical plate 27. When lever arm 17 is moved downwardly, point D moves vertically downwardly in a straight line to drive the punch blade vertically downwardly. In order to keep punch blade 26 level, a long link 36 is pivotably affixed at point F to link 34 creating a parallelogram linkage with a linkage identical to the above described linkage of elements 33, 34 and 35 except that the long handle is replaced by a third link 33' duplicating points A, C and F. Having dual mechanisms creates two spaced points D (FIG. 11) to keep the punch plate and hereafter described round hold punches level.

Figure 3:
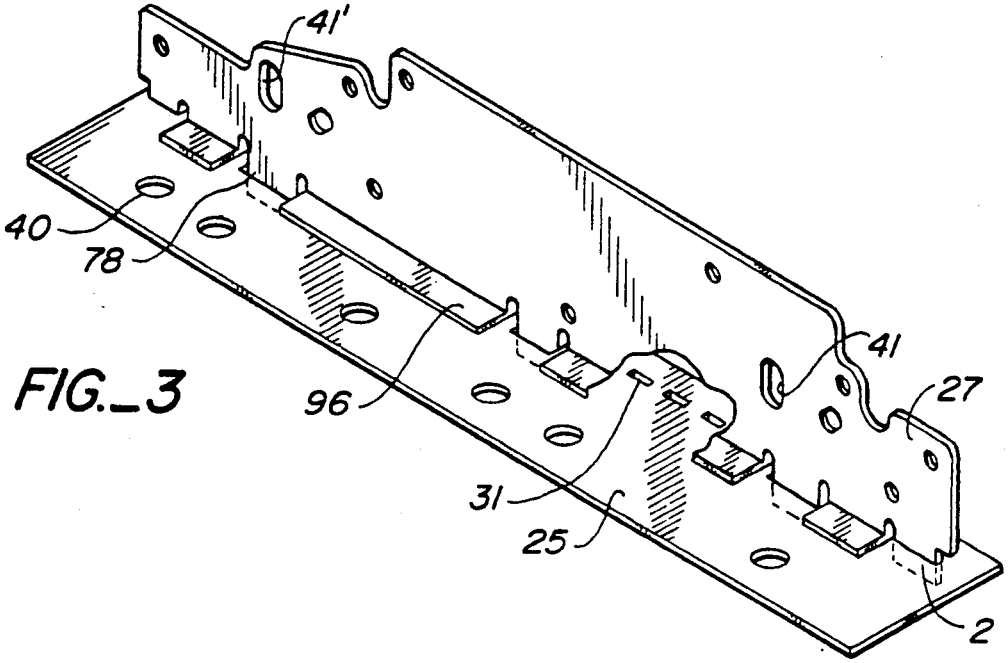
FIG. 3 is a partial cut away perspective view of an apparatus die plate and vertical link support plate.

The horizontal die plate 25 and a vertical plate 27 are affixed as by welding. Plate 27 bisects die plate 25 and is positioned by tabs 2 as seen in FIG. 3 where the row of rectangular hole die apertures 31 are on one side of plate 27 and a parallel row of round hole die apertures 40 are on the other side of plate 27. Vertical slots 41 and 41' allow for passage of pins representing point D therethrough so that the pin and the punch plate attached thereto move vertically in a straight line. The vertical plate may be displacedly positioned with respect to the linear edges (FIG. 1) so that it and its bent tabs 96 form insertion stops for paper sheets stacks as clearly shown in FIG. 22.

Figure 5:
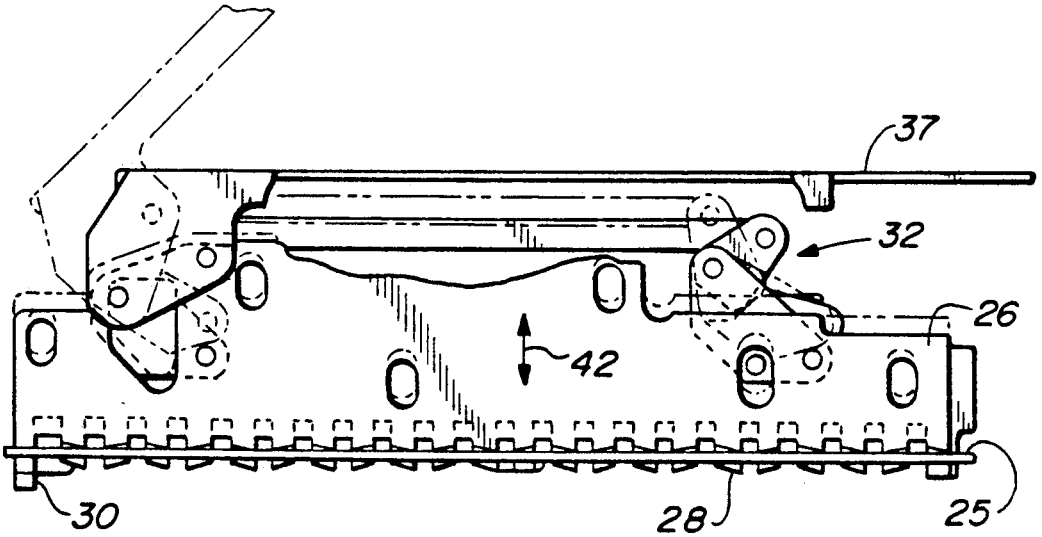
FIG. 5 is a side view of the punch plate, the lever and the four-bar linkages.

FIG. 5 illustrates the machined or ground cutting edges 28 of the punch blade 26 shown after completion of the hole punch stroke by lever support 37. The guide leg 30 is then in its lowermost portion. FIG. 5 also illustrates the portions of the four bar linkage 32 and punch blade 26 in dash-dot lines in the lever "up" position.

Figure 6:
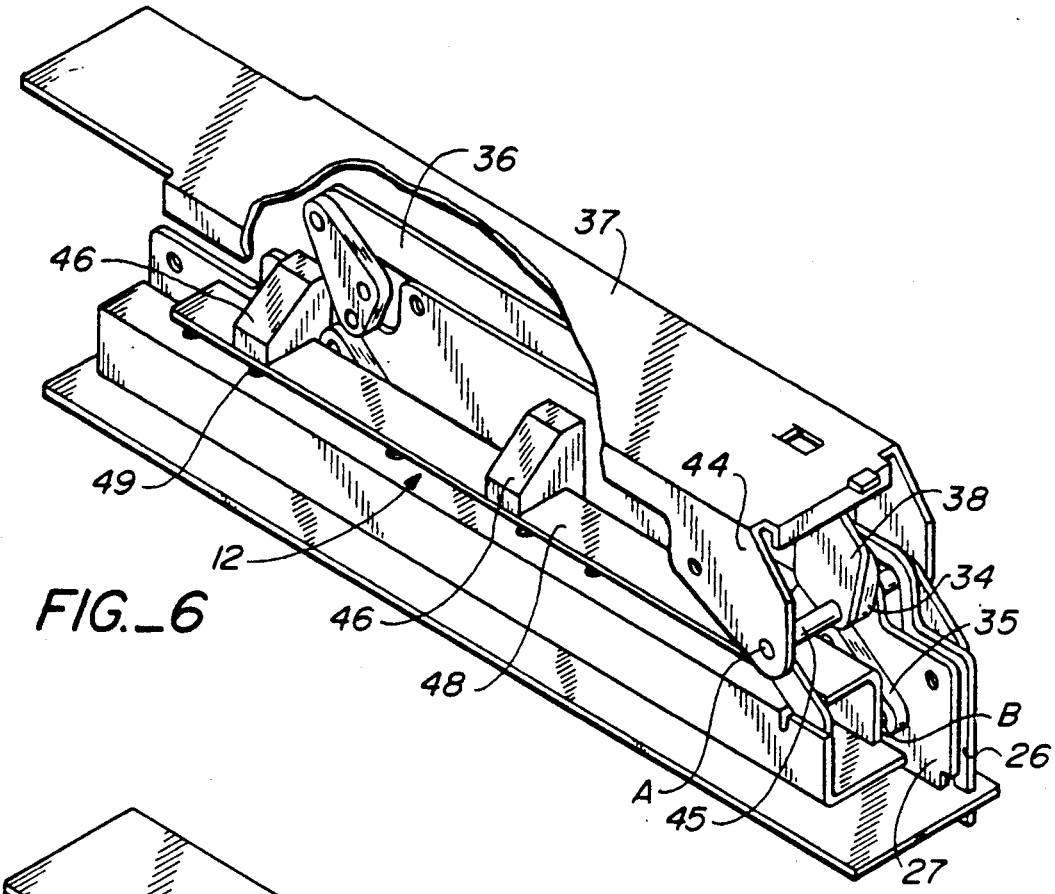
FIG. 6 is a cutaway perspective view of the round hole punch at lever stroke completion and also showing the lever connection.

FIG. 6 shows the side of the apparatus opposite from the rectangular hole punch blade which contains the round hole punch mechanism 12. Lever support 37 includes a pair of depending side portions 44 connected by pin 45 to handle mount 38 which is connected to link 34 by the pin 45.

Figure 8:
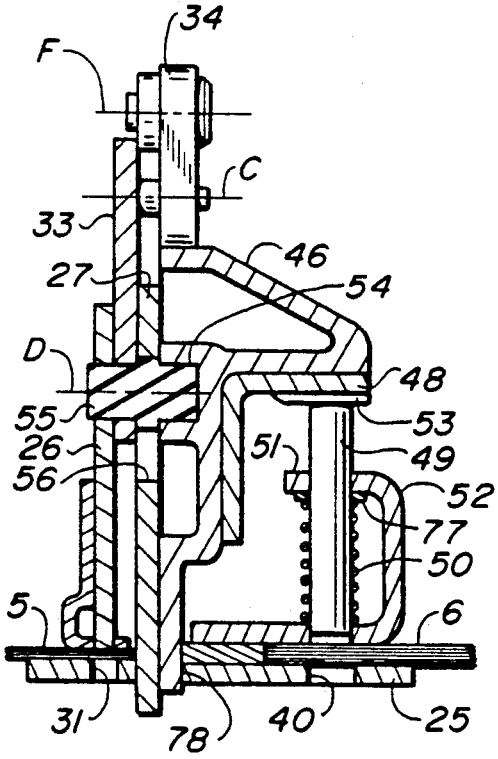
FIG. 8 is a cross sectional end view of the round hole and rectangular hold punch mechanisms prior to a punching stroke.
Figure 9:
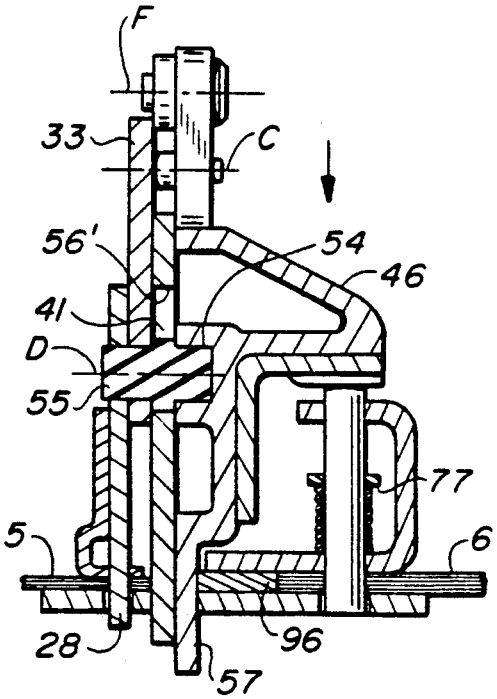
FIG. 9 is a cross sectional end view thereof upon completion of a punching stroke.
Figure 7:
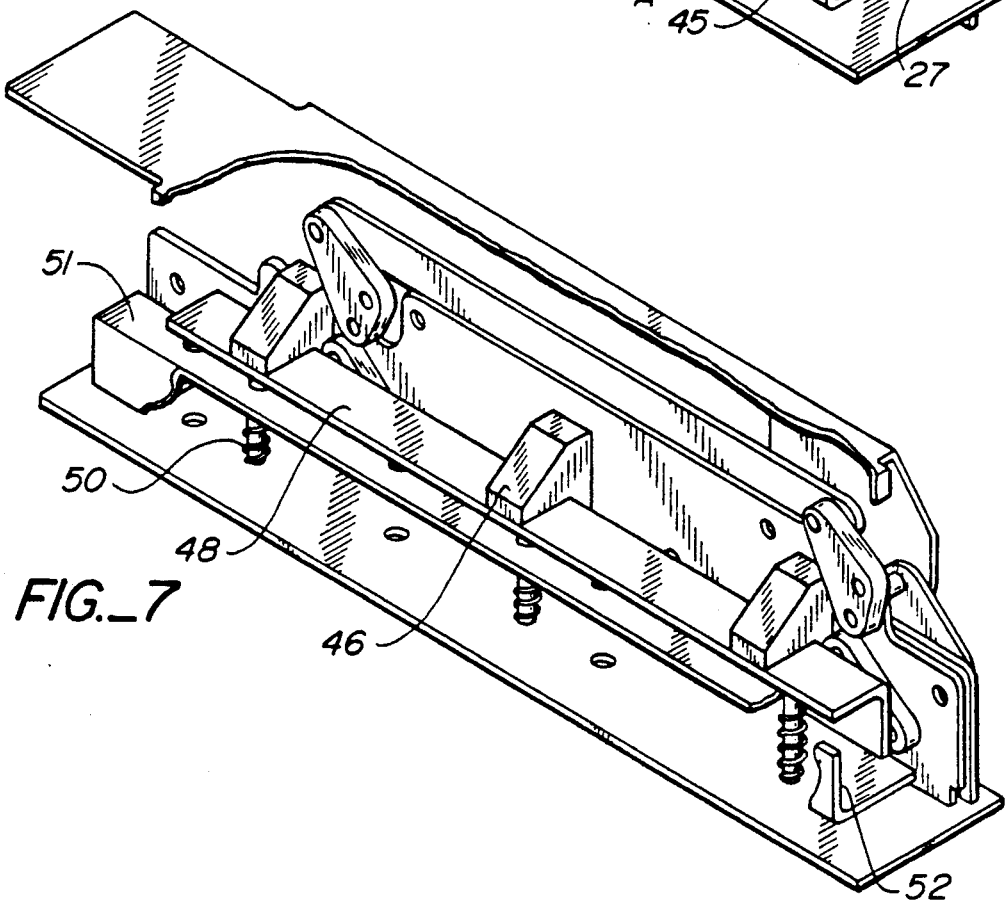
FIG. 7 is a cutaway perspective view of the round hole punch mechanism.

As seen in FIGS. 8 and 9 the point D represented by pin 55 extends through slot 41 in vertical plate 27 and is movable vertically with respect to the lower and upper slot edges 56 and 56', respectively. One end of pin 55 is fixed in punch plate 26 and the other end is fixed in a socket 54 in a vertically movable bracket 46. Interposed under the bracket 46 is a round punch actuator angle bar 48 which contacts the top of punches 49 extending vertically aligned with selected ones of the round hole apertures 40 in the die plate 25. Punches may be provided in two, three or four punch positions depending on the number and location of round holes desired in the paper sheets stack. While three punches are seen in FIG. 7, other combinations may be employed or a mechanism (not shown) provided to select particular ones of the punches for activation. A series of return springs 50 are provided within a punch housing 52, the tops of the punches 49 extending out from a top surface 51 of the housing 52. Collars 77 such as a snap-ring are affixed to punches 49 which function to compress an associated spring 50 when the punch is driven downwardly. Upon raising the lever the pins are returned by the spring expansion so that the punch tops extend above housing 52.

FIG. 8 illustrates the positioning of a marginal edge of a paper sheets stack 6 which has been guided into the proper position over and above an edge of die plate 25. The cutting end of punch 49 is shown above the stack and the die hole 40. The lever 17/37 is in the "up" position and pin 55 is above slot edge 56 and closer to slot edge 56'. Upon downward activation of the lever, pin 55 (and point D) moves down in a vertical straight line simultaneously driving both punch plate 26 and bracket 46 down so that both the rectangular punch elements 28 on the punch plate and the driven round hole punches 49 shear out rectangular holes and round holes, respectively, in paper sheets stack 5 and paper sheets stack 6, if in fact a stack has been inserted in both punch mechanisms 12 and 14 of the overall apparatus. Bumps 53 of varying progressive height may be placed on the interior of the actuator bar 48 so that each punch is first contacted at a different position of the downstroke. This allows the first punch 49 contacted to start stack compression and hole shearing and to better distribute the shearing forces to the respective punches. The brackets 46 also contain a bottom tail portion 57 which slidably guides the brackets through apertures 78 on die plate 25 and past abutting fixed vertical plate 27.

FIG. 9 shows the completion of the lever "down" stroke where the cutting edges of the punches have sheared round holes in paper sheets stack 6. Pin 55 at this point is abutting slot edge 56 which acts as a stop, and bracket 46 and attached tail 57 has slid to its bottom position. Upward movement of the lever raises the respective punch plate and brackets 46 and the springs 50 return the punches 49 to the pre-punch position shown in FIG. 8, ready for removal of the hole-punched stack(s) of paper sheets from the punch mechanism and ready for the next punching cycle.

It can be seen that the round hole punch mechanism can be used without insertion of paper sheets stack 5 into the other rectangular punch mechanism 14 or vice versa. While more pressure is necessitated, stacks 5 and 6 may be simultaneously punched by one lever/handle downward movement.

Figures 10, 11, 15:
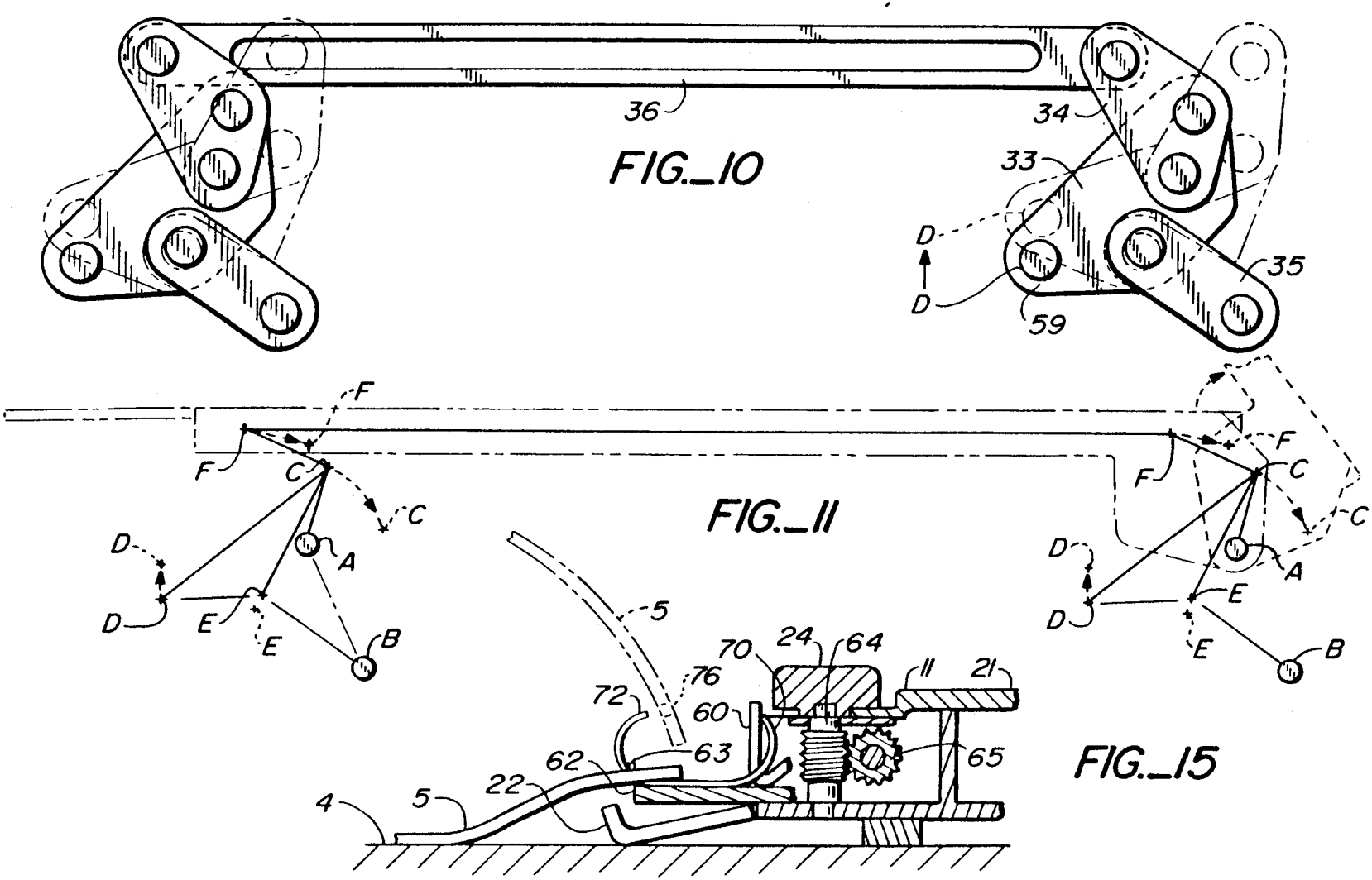
FIG. 10 is a schematic view of the coupled dual four-bar linkages.
FIG. 11 is a kinematic sketch of the dual four-bar linkage movements.
FIG. 15 is a partial, side cross-sectional view of the binding section taken transverse to the uncurl knob on line 15—15 of FIG. 12 illustrating the uncurling of the fingers and positioning of a punched hole paper stack thereon.

FIG. 10 shows in more detail the action of the four-bar linkage 32 with the respective elements 33, 34, 35 and 36 heretofore described, shown in full line outline after the lever "down" shear stroke and in dash lines in the lever "up" position. The result of this movement is to move full line point D to the dash line D in a vertical straight line 59 as indicated by the arrow.

FIG. 11 is a schematic representation of the dual four-bar linkages showing the fixed-to- the base portion points A and B on the lever and short link, respectively; movable point E on the short (rocker arm) link E-B; movable point C on the coupler plate; the movable point F on the lever arm; and the desired vertical straight line movement of point D on the coupler plate. The dash lines indicate the lever up position.

Figure 16:
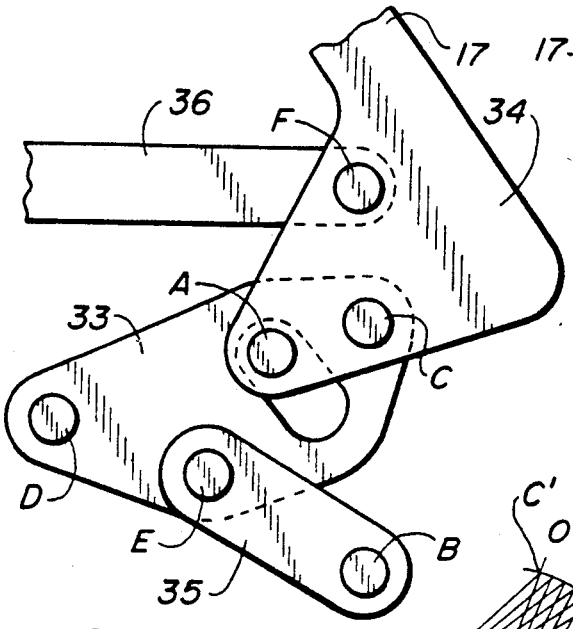
FIG. 16 is a schematic side view of the lever and of the four bar linkage in the lever up position.

FIG. 16 diagrammatically illustrates the operable four-bar link portions of the actuating mechanisms for the dual punch systems or for a single punch system. The handle 17 is shown raised to a 55° up position from its horizontal down position shown in FIG. 17. Fixed points A, B are common to each of FIGS. 16 and 17 and represent, respectively, the fixed pivot attachment of the handle pivot point A and short rocker arm fixed attach point B, both pivoted to the fixed base vertical plate 27 (FIG. 4). During the downward movement of handle 17 from a 55° up position in FIG. 16 to a 0° down position in FIG. 17, rocker arm 35 pivots about point B from about 5° to 7° so that the pin connecting point E to the coupler 33 moves from E to E'; point C connecting the link 34 to the coupler moves from C to C'; point F connecting the long link 36 to the link 34 moves from F to F'; and most importantly point D which connects the coupler 33 to the punch mechanisms moves from point D to D' in a vertical downward straight line. A computer program and printout was utilized to show the above motions graphically in FIG. 18. Movement of point C to C' in 5° increments from the handle at 55° (FIG. 16) to the handle at 0° (FIG. 17), with points A and B fixed show the small arc movement (5°–7°) of E to E' and the straight line downward movement of D to D'. It is also shown that the 5° steps which make up the progression of point D to D' are crowded very close together at the top of the stroke, i.e., during the first about 20° of downward movement from the 55° handle position. This means that there is more mechanical advantage (leverage) over the downward movement beginning from the 55° position to about the 35° position than over the remainder of the downward stroke. Specifically, as to one embodiment, the coupler mechanism multiplies the force 4.17 times at the beginning of the downward stroke gradually diminishing to 1.28 times at the bottom of the stroke to the 0° position.

The general type of four-bar linkage employed herein resulted from utilizing a standard method of search of a catalog or atlas of coupler curves. The catalog used was "Analysis of the Four-Bar Linkage" by John A. Hrones and George R. Nelson, John Wiley & Sons, Inc., N.Y., copyright 1951, by Massachusetts Institute of Technology. This catalog has 730 pages of about 6570 curves. A coupler curve is a path traced by a point (such as D in the present application), as a crank (line A-C herein) resolves about a pivot point (A herein). Thirty-six candidate curves were found and five promising ones of these were checked for accuracy. One of the curves on page 86, namely the curve generated by the second circular mark from the right on the linear locus of marks, had a portion which followed a straight line and indicated a good leverage performance. The links had the following proportions:

| | |
|---|---|
| LEVER A-C = | 0.50" |
| COUPLER LINK C-D = | 1.00" |
| ROCKER E-B = | 1.75" |
| BASE A-B = | 1.75" |
| From E to coupler point D is 0.559". | |
| ANGLE C-E-D is 116.6' | |

Slightly altering the above catalog linkage produced an acceptable straight line. A first working prototype was built using the proportions:

| | |
|---|---|
| LEVER A-C = | 0.50" |

-continued

| | |
|---|---|
| COUPLER LINK C-D = | 1.00" |
| ROCKER E-B = | 1.75" |
| BASE A-B = | 1.875" |
| From E to coupler point D is 0.676". | |
| ANGLE C-E-D is 116.7° | |

To fit size restraints of the production design, the rocker link had to be shortened to a length of 1.00". The distance from E to coupler point D became 0.875". ANGLE C-E-D became 116.9°. To achieve the closest approximation of a straight line for point D, a technique called concentric circular curve matching was employed to locate a new pivot center A and radius A-C.

The following proportions produced an extremely accurate straight line while maintaining the necessary mechanical advantage:

| | |
|---|---|
| LEVER A-C = | 0.55" |
| COUPLER LINK C-D = | 1.20" |
| ROCKER E-B = | 1.00" |
| BASE A-B = | 1.278" |
| From E to coupler point D is 0.875". | |
| ANGLE C-E-D is 116.9°. | |

Figure 17:
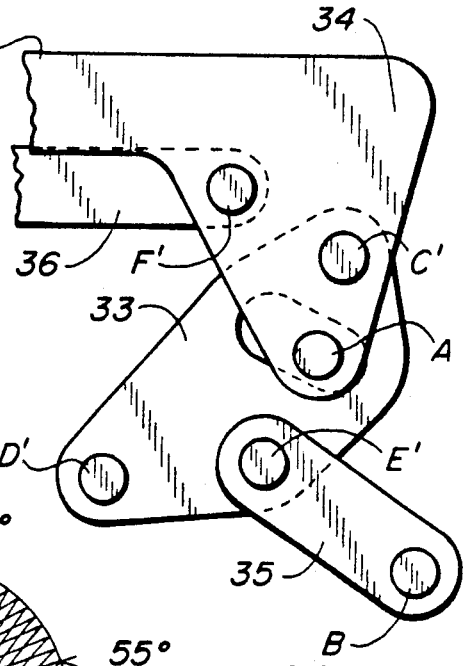
FIG. 17 is a schematic side view in the lever down position.
Figure 18:
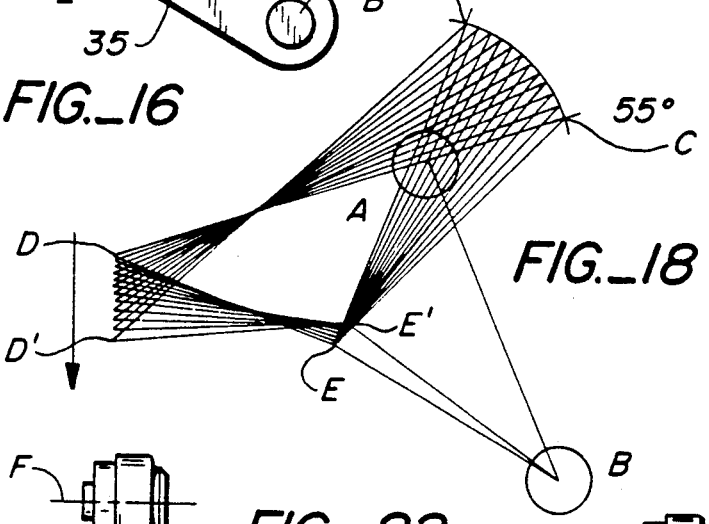
FIG. 18 is a graphical representation of the movement of the lever over 55° and showing the corresponding movements of the four bar linkage in 5° increments of travel.

FIGS. 16–18 represent a true relative scale of an optimized four-bar linkage to drive a punch or a punch plate or other handle-operated, pressure-producing apparatus vertically downwardly to provide a straight line vertical force having the desired mechanical advantage at one end of the stroke. While the four-bar linkage has been described with the highest mechanical advantage of the straight line movement at the top of the stroke, in certain applications the bottom part of the stroke may require the greater mechanical advantage. This is so in the case of a hand-lever operated print impression device which embosses a workpiece with a waxy-metallized material by action of a movable die, e.g., a booklet title on a cover.

Figure 12:
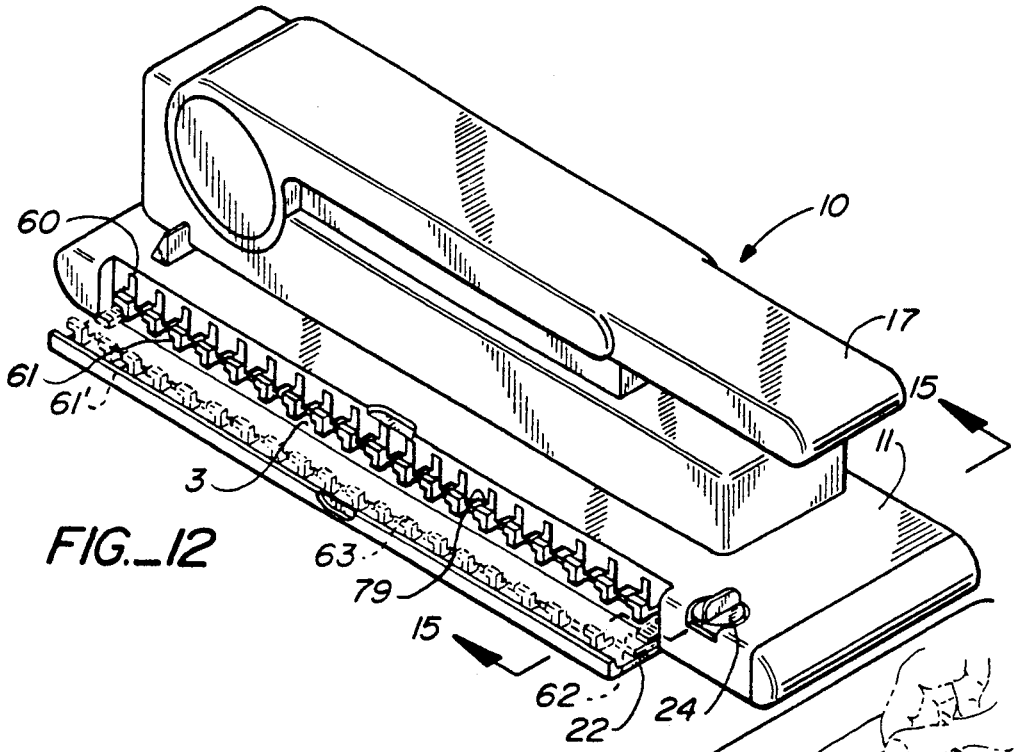
FIG. 12 is a perspective view of the apparatus showing the binding station in open condition.

FIG. 12 illustrates the details of the binding station within door 22. Opening of door 22 allows access to a binding comb including a fixed row of narrow vertical pickets 60. A horizontal rectangular plate 62 extends under the pickets and mounts a corresponding series of push fingers 61 having cantilevered horizontal ends 63 extending parallel to the picket row. The plate 62 is extendable outwardly by a gear mechanism operable by rotary movement of knob 24 into the dashed line position for uncurling the loops of a Douvry-type binding element.

Figure 13:
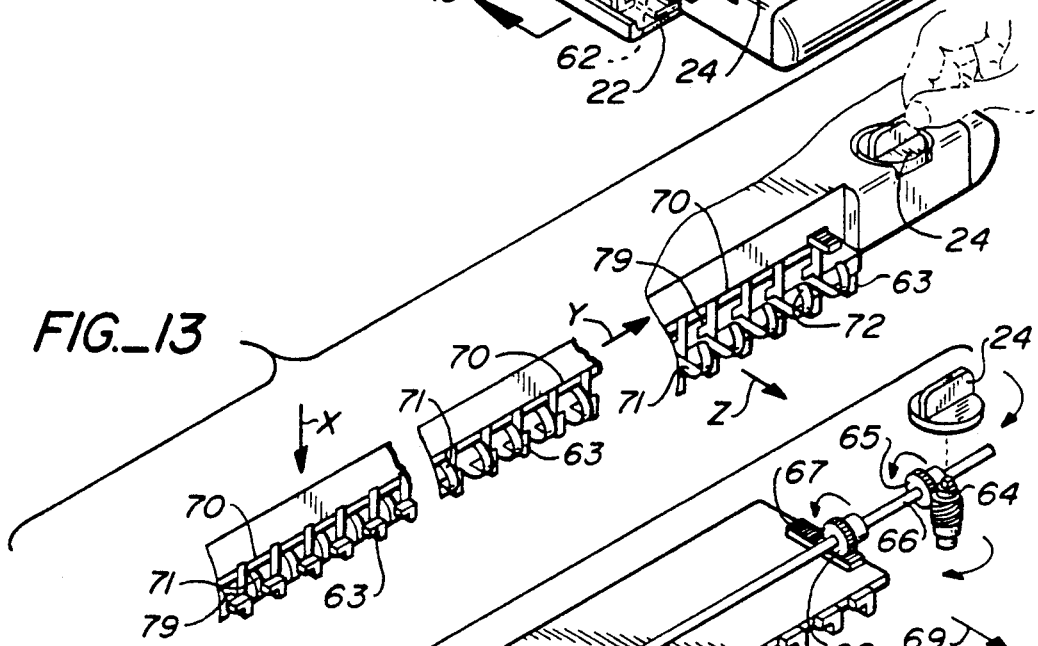
FIG. 13 illustrates the three manual binding operational motions.

The narrow pickets 60 include an integral arm or tab 79 extending at right angles from the left side of the picket in FIG. 12 and more clearly shown in FIG. 13 in the Z step. The arm 79 is coextensive with and in the same horizontal plane as the cantilevered ends 63 of the push fingers so that in the "loops closed" position in step X the arms 79 and ends 63 abut each other to form a double thickness of horizontal bars. Each loop is positioned behind each arm and push finger end by performance of step Y. The cantilevered ends 63 which are affixed to plate 62 are then moved outwardly by the gear interconnection train driven by knob 24. Arms 79 keep part of the loop behind arms 79, while the more forward part of the loop is guided outwardly by ends 63, thus uncurling and opening the loop as shown in FIG. 15.

FIG. 13 shows the three step operation of the binding station. In Step X, the Douvry-type plastic binding element spine 70 is positioned behind the pickets 60 with each of the integral resilient plastic curled loops 71 extending between a pair of contiguous pickets and to the left of the cantilevered ends 63 of the push fingers. Sufficient clearance is provided behind the pickets so as to accommodate spines having a diameter of from about 0.5 cm to 1.6 cm. Other models can accommodate a broader range of binding element spine sizes. The user then in step Y manually shifts the binding element to the right so the loops are then situated and aligned behind all the cantilevered ends of the push fingers and abut the left vertical edge of the narrow pickets 60. In Step Z, the knob 24 is rotated to move plate 62 laterally outwardly from the pickets with the cantilevered ends of the push fingers uncurling the ends 72 of all the loops 71.

Figure 14:
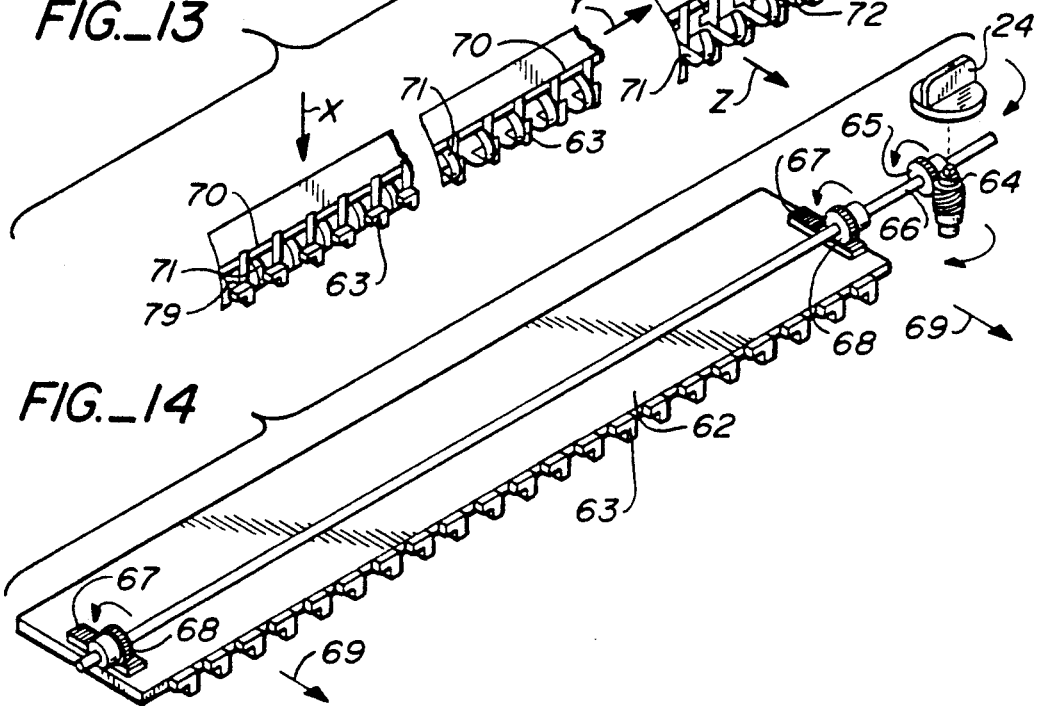
FIG. 14 is a perspective view of the push finger plate and interconnecting gearing between the control knob and the plate.

As seen in FIG. 14, the gear mechanism includes a vertical helical gear 64 attached at a top end by a stub shaft to knob 24 and at its bottom end of a stub shaft journalled in the base section 19. A worm gear 65 in engagement with gear 64 is attached to shaft 66, and a pair of spur gears 68 fixed on the shaft 66 are engaged with a pair of horizontal rack segments 67 fixed to the top of plate 62. Turning of knob 24 as arrow indicated rotates the helical gear, the worm gear, the shaft and the spur gears such that the engagement of the spur gears with the racks 67 drive the plate and its attached push fingers laterally outwardly from the recess in the lower base section as shown by arrows 69. The worm gear gives a high mechanical force advantage in driving plate 62 outwardly and is self-locking so that the loops stay in the uncurled position when a user removes his fingers from the knob.

After the loops have been uncurled as shown in FIG. 15 the paper stack 5 with its series of pre-punched rectangular holes 76 is threaded or impaled on the uncurled loop ends 72 and after so doing the knob 24 is rotated counter-clockwise bringing the plate 62 and push fingers back into the base portion recess and allowing the resilient fingers to automatically recurl binding the paper sheets stack into the binding element.

Note should be made that the plate 62 in its "out" position in FIG. 15 extends under the entire expanse of the loops from fixed arm 79 (and picket 60) to end 63 so that the loops are supported on their bottom surfaces in a horizontal alignment with the plate as they are uncurled and thus less of a plate stroke or push finger stroke is needed than in those mechanisms of the prior art wherein the loop bottoms are unsupported and sag when being uncurled, thus requiring a longer push finger stroke.

It is also contemplated that a second binding station may be present on the opposite side of the punch apparatus having door 22, i.e., in front of linear edge 16 and below the round punch mechanism 12, which can be used for different binding systems. For example, a binding station for removing the excess length of posts or studs of a Velo-Bind binding strip and upsetting the remaining ends into strip counterbores may be provided. Further, the round hole punch mechanism 12 may be designed to punch a paper sheet stack with the number of small diameter holes required in the Velo-Bind binding strip by merely providing more punches 49 but with a smaller diameter.

FIG. 19 shows an embodiment of the invention in which a motor 80 replaces the handle 17 and pivotally connects to the link 34 and to long link 36 by a drive link 81. A servo-type control (not shown) may be used to control step-wise or continual arcuate rotation of motor 80 in the direction of arrow 82 to move the punches and punch plate downwardly.

Figure 22:
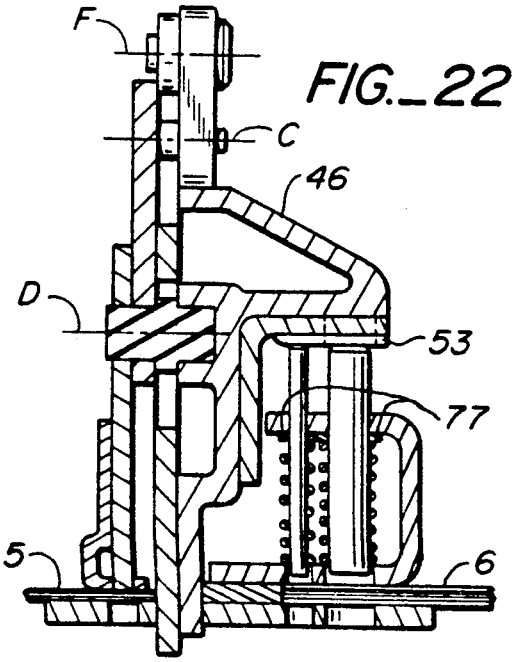
FIG. 22 is a cross sectional end view of the dual round hole embodiment of FIG. 20 taken with the rows of round punches in a pre-punch lever-up condition.
Figure 23:
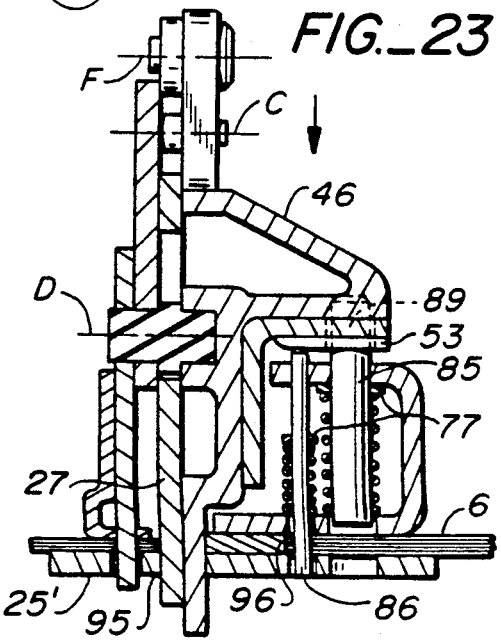
FIG. 23 is a cross sectional end view thereof upon completion of a punching stroke where the smaller of the round punches is operative to punch holes in a first paper stack and the rectangular punch plate punches rectangular holes in a second paper stack.

FIG. 20 shows a further embodiment of the invention where dual sets of punches are provided in punch mechanism 12. The larger outer row 85 of punches are usable for conventional two-three-or four hole punching while the inner row 86 of some 10, 11 or 12 punches are useful in the Velo-Bind-type binding strip system. The holes in each set of rows are laterally displaced from each other and bar 87 is laterally displaceable so as to allow one row of punches to be operative and the other row inoperative. This is shown in FIG. 21 where angle bar 87 is shifted by handle 93 so that large punch 85 is spring-pressed through hole 89 to be inoperative while small punch 86 is forced downward by depression of bar 87 by the four-bar linkage against the small punch tops 91 as in FIGS. 6–9 to perforate a stack of paper sheets inserted into gap 92. In a laterally shifted position of angle bar 87 the small punches 86 are made inoperative by being lined up with small holes 94 and passing therethrough with the larger punches 85 being depressible by single bar 87 being driven downwardly by the four bar linkage. The compression springs are omitted from FIG. 21 to avoid clutter. FIGS. 22 and 23 show this action more clearly with the small punches 86 having in a pre-punch cocked position (in FIG. 22) abutting integral ridge member 53 in the handle up position and the large punches passing through bar apertures 89 and in front of or behind brackets 46. In the down position (FIG. 23), the small punches have pierced the paper sheet stack 6 while punches 85 remain spring-pressed outwardly. FIGS. 22 and 23 also illustrate how the peripheral edge 95 of the stack 5 abuts the vertical plate 27 so as to have the rectangular perforations at the proper distance inwardly from the edge 95. Likewise, vertical plate 27 has integral flat tabs 96 (FIG. 3) which extend on the top of the die plate 25' and which have a peripheral end which is abutted by stack 6 to either perforate small round holes (for a Velo-Bind binding) close to the peripheral edge of stack 6 or larger conventional round holes more inboard of the inserted edge of the paper sheets stack 6. This construction is similarly shown in FIGS. 8 and 9.

The above description of the preferred embodiments of this invention is intended to be illustrative and not limiting. Other embodiments of this invention will be obvious to those skilled in the art in view of the above disclosure.

We claim:

1. A binding apparatus comprising a base portion and a binding means, said binding means extending from said base portion for binding a stack of punched paper sheets with a plastic binding element having an elongated linear spine and integral spaced resilient curled fingers extending from the spine;

said binding means including a fixed binding comb and a series of push fingers, said binding comb including a series of upstanding fixed spaced pickets, said push fingers extending outwardly from and being fixed laterally with respect to said pickets;

said pickets having sufficient clearance between each other to allow the binding element curled fingers, when inserted between and behind said fixed pickets, to be manually shifted laterally relative to said fixed pickets such that an interior of each one of the curled fingers surrounds in seriatim a portion of each of said push fingers; and in which said binding means further comprises means for moving said push fingers laterally outward from said pickets to uncurl the curled fingers of the binding element during a binding operation to a position for receipt of a paper sheets stack on the uncurled fingers.

2. The binding apparatus of claim 1 in which said means for moving said push fingers includes a manually-operated mechanism extending from said base portion adjacent said binding comb and interconnect gearing extending between said manually-operated mechanism and said push fingers.

3. The binding apparatus of claim 2 wherein said manually-operated mechanism includes a rotary knob and said gearing comprises a helical gear connected to said knob, a worm gear engaged with said helical gear, a horizontal interconnect plate mounting said push fingers, a pair of racks spacedly mounted on said interconnect plate, a rotary shaft extending connectively from said worm gear, and a pair of spur gears mounted on said shaft and in operable engagement with a respective one of said pair of racks to move said interconnect plate and said push fingers outwardly and inwardly to open and close the curled fingers.

4. The binding apparatus of claim 1 wherein said pickets have a narrow width such that an operating user can insert the binding element spine over and behind the pickets with each of the resilient curled fingers extending between a pair of contiguous pickets and can manually translate the binding element laterally so that all of said push fingers are situated behind the curled fingers.

5. A binding apparatus comprising a base portion and a binding means, said binding means extending from said base portion for binding a stack of punched paper sheets with a plastic binding element having an elongated linear spine and integral spaced resilient curled fingers extending from the spine;

said binding means including a fixed binding comb and a series of push fingers, said binding comb including a series of upstanding fixed spaced pickets, said push fingers extending outwardly from and being fixed laterally with respect to said pickets;

said pickets having sufficient clearance between each other to allow the binding element, when inserted between and behind said fixed pickets, to be shifted laterally relative to said fixed pickets such that an interior of each one of the curled fingers surrounds in seriatim a portion of each of said push fingers;

in which said binding means further comprises means for moving said push fingers laterally outward from said pickets to uncurl the curled fingers of the binding element during a binding operation to a position for receipt of a paper sheets stack on the uncurled fingers; and in which each of said pickets includes an integral arm extending at right angles therefrom, said integral arms being positioned to keep a portion of the curled fingers between said pickets when the curled fingers are uncurled for receipt of an apertured paper sheets stack on the uncurled fingers.

6. A binding apparatus comprising:

a base portion; and a binding means extending from said base portion for binding a stack of punched paper sheets with a plastic binding element having an elongated linear spine and integral spaced resilient curled fingers extending from the spine;

said binding means including a fixed binding comb and a series of push fingers, said binding comb including a series of upstanding fixed spaced pickets;

wherein said pickets have a narrow width such that an operating user can insert the binding element spine over and behind said pickets with each of the resilient curled fingers extending between a pair of contiguous pickets and can manually translate the binding element laterally in a space between the pickets so that a portion of all of said push fingers are situated behind the curled fingers, and in which said binding means further comprises means for moving said push fingers laterally outward from said pickets to uncurl the curled fingers of the binding element during a binding operation to a position for receipt of a paper sheets stack on the uncurled fingers.

7. The binding apparatus of claim 6 further including an elongated edge recess in said base portion; said push fingers operably extendable from said recess; and a binder door closable to cover said binding comb and push fingers when said binding means is not being utilized and said push fingers are retracted in said recess.

8. A binding apparatus comprising a horizontal base portion and a binding means, said binding means extending from said base portion for binding a stack of hole punched paper sheets with a plastic binding element having an elongated linear spine and integral spaced resilient curled fingers extending from the spine;

said binding means including a binding comb and a series of push fingers mounted on a horizontal plate, said binding comb including a series of upstanding spaced pickets, said push fingers extending outwardly with respect to said pickets;

said horizontal plate being mounted to move outwardly from said base portion parallel to a table work surface on which the binding apparatus sits;

each of said curled fingers being movable to a position behind an end of a respective push finger;

means for moving said push fingers and said horizontal plate laterally outward from said pickets to uncurl the curled fingers of the binding element during a binding operation to a position for receipt of a paper sheets stack on the uncurled fingers, said paper sheets stack having a hole-punched edge supported on said horizontal plate and an opposite edge of the stack supported on a platen formed by the table work surface.

9. The binding apparatus of claim 8 in which said base portion includes an open vertical edge providing access to an elongated recess in said base portion, said horizontal plate, said push fingers thereon and said pockets being storable in said recess, and said horizontal plate and said push fingers being movable from said recess to uncurl the curled fingers of the binding element.

10. The binding apparatus of claim 9 further including a hinged door normally covering said open vertical edge and said recess, said door being openable to rest on the table work surface and to allow outward movement of said horizontal plate from said recess and to a position above said hinged door.

11. The binding apparatus of claim 8 in which said means for moving said push fingers and said horizontal plate includes a rack and pinion such that said horizontal plate is self-locking when the curled fingers are in the uncurled position.

* * * * *